United States Patent [19]

Kirkham, Jr.

[11] Patent Number: 4,471,794

[45] Date of Patent: Sep. 18, 1984

[54] HAMMOCK TENT SYSTEM

[76] Inventor: Arthur J. Kirkham, Jr., 9381 Peacock Dr., Sandy, Utah 84070

[21] Appl. No.: 404,040

[22] Filed: Aug. 2, 1982

[51] Int. Cl.[3] ..... A45F 1/00

[52] U.S. Cl. ..... 135/95; 5/120

[58] Field of Search ..... 135/87, 90, 95, 96, 135/120, 117; 5/120, 121, 128, 413, 414, 418, 113, 115–118, 123–127, 130; 224/153–156

[56] References Cited

U.S. PATENT DOCUMENTS

| | | | |
|---|---|---|---|
| 1,464,875 | 8/1923 | Hull et al. | 224/154 |
| 1,917,518 | 7/1933 | Goudie | 5/120 |
| 2,554,688 | 5/1951 | Vollweiler | 135/95 |
| 3,590,864 | 7/1971 | Vechesloff | 135/96 |
| 3,800,814 | 4/1974 | Hibbert | 135/95 |

FOREIGN PATENT DOCUMENTS

| | | | |
|---|---|---|---|
| 475017 | 1/1915 | France | 135/95 |
| 25324 | of 1906 | United Kingdom | 135/87 |

*Primary Examiner*—Richard J. Apley
*Assistant Examiner*—S. R. Crow
*Attorney, Agent, or Firm*—B. Deon Criddle

[57] ABSTRACT

A tent structure comprising a substantially rectangular sheet of suitably flexible material, such as canvas, and including an upright support pole comprised of a plurality of interlocking sections. The tent structure is adaptable as a hammock by folding in a manner such that sections of the pole used for upright support of the tent are utilized as attachments to the ends of the folded fabric.

The tent structure is adapted to several configurations including that of a "lean-to".

1 Claim, 7 Drawing Figures

HAMMOCK TENT SYSTEM

BACKGROUND OF THE INVENTION

1. Field of the Invention

This invention relates to tent structures and particularly to those structures that are adaptable to other uses such as hammocks and so forth.

2. Prior Art

Tents have long been used as temporary shelters. Tents have been generally designed to be relatively low in cost, light in weight, and readily assembled. Tents are available in many different styles and sizes, with a wide variety of support structures, and various materials have been developed for use in tent construction.

A principal objective in modern tent design and construction has been the elimination, so far as possible, of both interior and exterior encumbrances such as guy ropes and the like. Elimination of such encumbrances reduces the weight of the tent, and the weight of the tent becomes important inasmuch as a camper or hiker will be carrying other supplies and equipment in addition to the tent. Many of the older tents which utilized elaborate internal and external members were difficult to erect, requiring a great deal of time and expertise. Erection of such tents were most difficult for one person without additional help. Elimination of as much unnecessary items as possible from a tent will also, of course, reduce the cost of the tent. As a general proposition, the simpler the tent, the less it will cost. Simplifying construction of the tent allows the manufacturer to select the best materials for each part, while still maintaining an economical cost.

The cost of a tent becomes very important when the tent is designed for use by only one person, such as a hiker who may be outdoors for a relatively short time. Further, because of the practical limits regarding how much equipment a person can carry, the tent should be versatile. It would be particularly advantageous if the tent could be designed in such a way that it can be erected quickly in the event of a sudden rainstorm and so forth, as well as having the capability to be used for other purposes when not being used as a shelter. Such other uses might include a hammock.

So far as I am aware, no one has developed a combination tent-hammock construction that is specifically designed to be adaptable for easy use as a hammock and that has the further capability of functioning in different tent structure configurations.

PRINCIPAL OBJECTS OF THE INVENTION

It is a principal object of the present invention to provide a structure that can be used alternatively as a hammock and a tent.

Another object of the invention is to provide a tent structure that can be used in a plurality of shelter configurations without the necessity of a large number of either interior or exterior encumbrances. In particular, it is an object of the invention to provide a tent which can be quickly erected as a "lean-to" for a temporary shelter during a sudden rainstorm, etc., and which also can be erected in more conventional "pup tent" configuration, i.e., having the usual gable formation, for overnight use.

Still another object of the present invention is to provide a versatile tent structure that is very light in weight.

Yet another object of the present invention is to provide a tent structure that can be stored carried in a very small volume.

Another object of the present invention is to provide a tent structure constructed in such a fashion that it can be used as a tarp or ground cover.

FEATURES OF THE INVENTION

Principal features of the invention include a rectangular sheet of a suitable flexible material, having attached to its perimeter a plurality of conventional tie lines. The front and rear edges of the tent material, with reference to its position when erected, are folded back and stitched to form casings, and an opening is provided in each of the casings midway along the lengths of the casings. The casings are adapted to accomodate a support pole as will be more fully described hereinafter.

The support pole in the preferred embodiment of the invention is a four-piece tubular metal apparatus. Depending upon the desired elevation of the tent configuration one or more of the metal sections can be used by adjoining the sections end to end. Each tubular metal section contains a male and female end for purposes of attachment.

When the apparatus of the invention is to be used as a "lean-to" or a "pup tent", the metal pole sections are used to support the midportion of the opposite ends of the sheet material in an elevated position, and the respective sides of the sheet material are either staked to the ground or supported by ropes from trees or other supports. When the tent invention is to be used as a hammock, the main sheet material is folded lengthwise about its longitudinal axis such that the sections of the casings between the central openings and the opposite ends of the casings are overlapping and parallel. Through each section of casing is inserted one of the four sections that comprise the support pole. A sturdy strap can then be wrapped around each protruding end of the metal pole sections at each end of the folded material, thus bunching the tent sleeve fabric on the respective pole sections. The stress on the end fabric of the tent material is accordingly distributed uniformly throughout the length of the casing sections. The strap which is wrapped around the pair of metal sections that support one end of the hammock is then brought together at its loose ends resulting in a triangular configuration, the apex of which can be attached by conventional means to a tree or the like.

Additional objects and features of the invention will become apparent from the following detailed description and drawing disclosing what is presently contemplated as being the best mode of the invention.

THE DRAWING

DETAILED DESCRIPTION OF THE DRAWING

Figure 1:
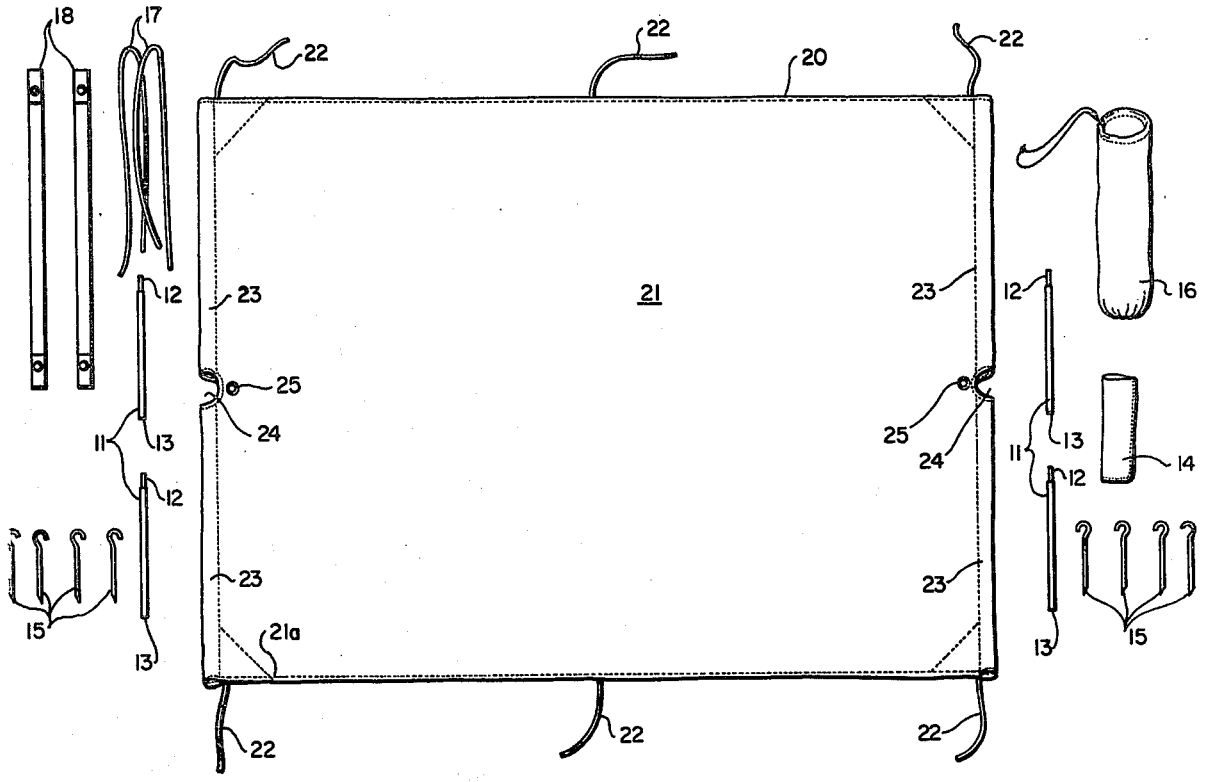
FIG. 1 is a plan view of the associated components of the hammock invention.

Referring now to the drawings:

The components of the combination hammock and tent apparatus of the present invention are shown generally in FIG. 1. The apparatus of the invention includes four identical tubular metal support poles 11, each having a male end 12 and female end 13. Also included is a bag 14 used to carry all the components of the invention. Two sections of rope 17, two straps 18 with grommets 19 at each end and eight metal stakes 15 are also provided in the apparatus as illustrated.

The main tent portion 20 of the invention is a large sheet of lightweight but strong, flexible and waterproof material 21 having the shape of a large rectangle. Attached at each corner of the main tent portion 20 and at a point midway on the longitudinal edge of the sheet 21 are tie straps 22.

The opposite longitudinal ends of the sheet of material 21 are folded over, respectively, and sewn in a manner to define tubular casings 23 at the opposite ends of the sheet of material 21. The sheet of material 21 is reinforced at its other edges 21*a* to ensure a long product life.

Openings 24 are located at a point midway along the respective casings 23. Located near each of the respective openings 24 are center grommets 25 which are sized to accept only the male 12 end portion of a metal support pole 11.

Figure 2:
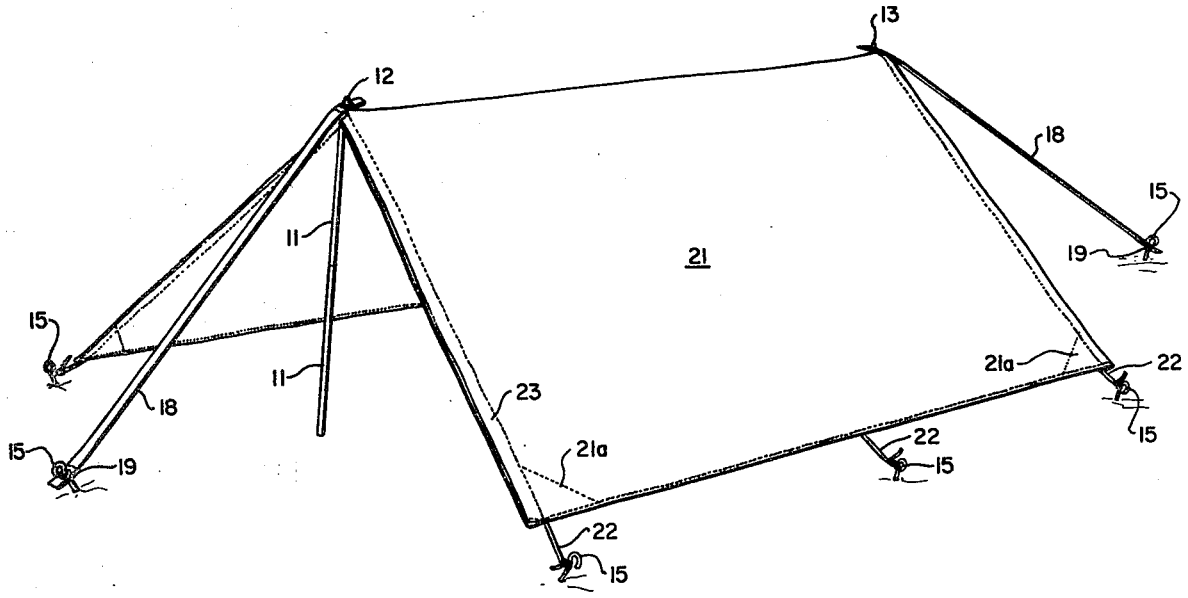
FIGS. 2–5 are perspective views of the present invention assembled in various tent structure configurations.
Figure 3:
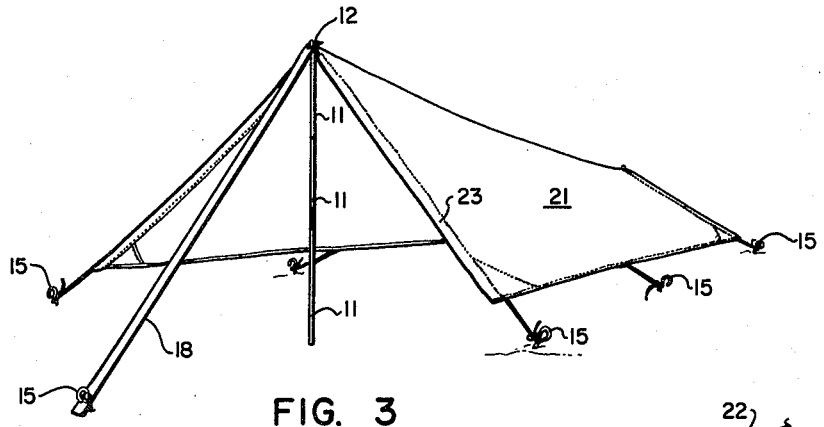
Figure 5:
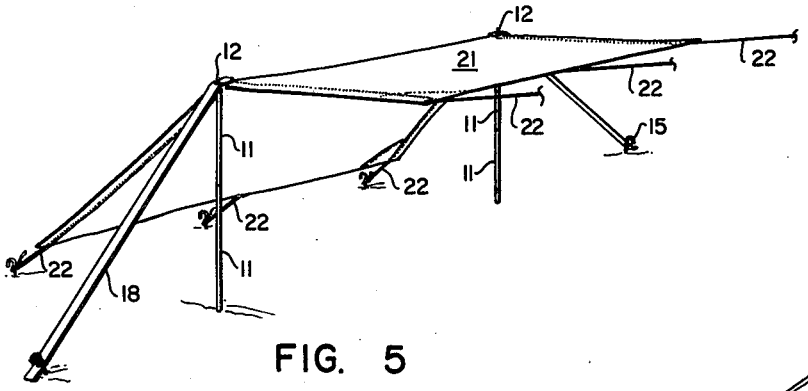

Uses of the combination hammock and tent apparatus of the present invention in various tent configurations are illustrated in FIGS. 2, 3 and 5. These uses follow well-known techniques. Support poles 11 are attached in pairs end to end to establish the height of the structure. The male ends 12 of the top support pole are fitted through respective center grommets 25. Straps 18 are secured respectively to the portion of the support poles 11 protruding through center grommets 25 by fitting respective grommets 19 at mutually respective ends of straps 18 over portions of the support poles 11 which protrude from grommets 25. The other end of straps 18 are then attached to the ground by two of the metal stakes 15. In a similar manner the straps 22 along the side edges of the sheet of material 21 are secured to the ground using the other six metal stakes 15 to complete the tent structure in the desired configuration. The well-known "pup tent" configuration with standard gabled structure is illustrated in FIG. 2.

FIG. 3 illustrates a variation of the "pup tent" configuration. The variation includes the use of three poles 11 in the front area of the tent and one such pole 11 at the foot of the tent. The increase in height derived from the use of the extra pole at the front of the tent allows the lower edge of the sloping walls at the front of the tent to be elevated from the ground which, in turn, results in increased passage of air through the tent.

Figure 4:
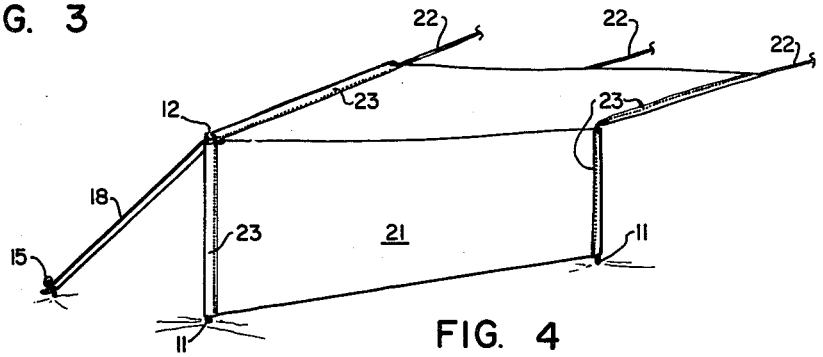

FIG. 4 illustrates the tent structure in a configuration that could be used, for example, as a wind break. Two support poles 11 are inserted in respective sections of the casings 23 on the same side of the main body 20 and support one-half of the sheet of material 21 in a vertical position maintained by straps 18 secured to the ground with stakes 15 in the usual manner. The other half of the sheet of material 21 can be extended outwardly in a horizontal or near horizontal angle and is secured by tie straps 22 to trees, rocks or whatever might be available.

FIG. 5 illustrates the use of the tent invention in a variation of the well-known "lean-to" configuration. In this example the support poles 11 and one-half of the sheet of material 21 are set up as they might be for a traditional "pup tent" configuration, but one-half of the main body is extended outwardly at a horizontal inclination and secured to trees or the like.

The structures in FIGS. 2–5 are, of course, only illustrations of possible tent configurations. The specific structure used by a camper is limited only by the imagination and various natural structures that might be present in the area where the tent apparatus is to be used.

Figure 6:
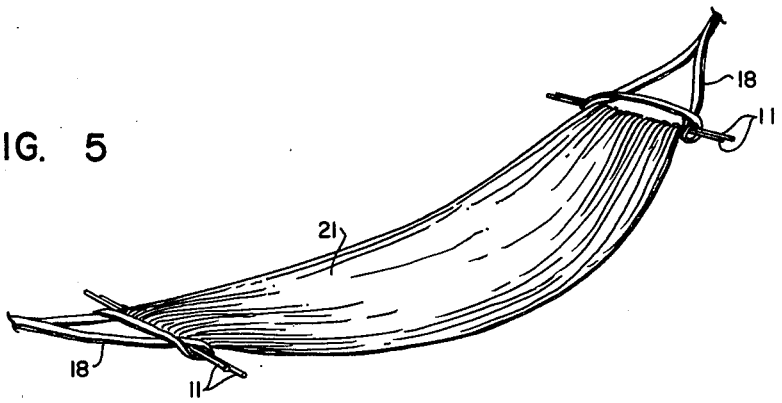
FIG. 6 is a perspective view of the present invention assembled as a hammock.
Figure 7:
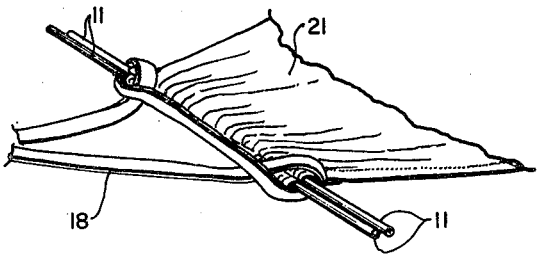
FIG. 7, is a detailed view illustrating the methods used for support at the ends of the sheet material when the apparatus is assembled as a hammock.

To utilize the apparatus of the invention as a hammock, FIGS. 6 and 7, the sheet of material 21 of the invention is folded longitudinally so as to superimpose the halves of the main body. A metal support pole 11 is then inserted into each of the four sections of the casings 23. The fabric of the sheet of material 21 is then bunched together as shown in FIGS. 6 and 7. At each end of the sheet of material 21 a strap 18 is wrapped around the two poles 11 at that end which protrudes from the ends of the bunched casings 23, as shown in FIG. 7, to distribute stress along the entire length of the metal poles 11 and fabric 21. The straps 18 can then be attached to surrounding trees or the like.

The hammock and tent apparatus of this invention is not limited in use to a tent or hammock configuration. It may also be used as a ground cover and a number of other uses either singly or in combination with other equipment used in outdoor recreation.

Although a preferred form of the invention has been herein disclosed, it is to understood that the present disclosure is by way of example and that variations are possible without departing from the subject matter coming within the scope of the following claims, which subject matter I regard as my invention.

I claim:

1. Apparatus for making a tent or hammock comprising:

a main body of suitable flexible and waterproof material of generally rectangular shape, said main body having respective openings midway between the transverse edges of said main body;

hollow casings sewed integrally in the transverse edges of said main body so as to extend, respectively, from said midpoint openings to the longitudinal edges of said main body whereby when the main body is folded in half longitudinally adjacent casings overlie one another;

support means for holding said main body in a plurality of structural configurations, said support means including four support poles, each of said poles having a female end and a protruding male end of diameter smaller than that of the shaft of said pole whereby said poles may be telescoped together and each pole being shorter than a casing;

a pair of grommets one each of which is located on the longitudinal center line of the main body and near said midpoint openings in said main body;

a plurality of tie straps one each of which is permanently attached to said main body at each corner and at a point along the longitudinal edge of said main body; and at least two support straps, said support straps having a grommet at each end sized to accept the male end of said support poles and said strap being sufficiently long to wrap around projecting opposite ends of a pair of the poles inserted through the casings and to have free ends thereof to engage a rigid support means when said main body is longitudinally folded to be in a hammock mode.

* * * * *